United States Patent [19]

Hardison et al.

[11] Patent Number: 4,667,609

[45] Date of Patent: May 26, 1987

[54] APPARATUS AND METHOD FOR TREATMENT OF SOIL CONTAMINATED WITH HYDROCARBONS

[76] Inventors: Robert Hardison, 12234 Circula Panorama, Santa Ana, Calif. 92705; N. Robert Crain, 9432 Daytona Cir., Huntington Beach, Calif. 92646

[21] Appl. No.: 904,570

[22] Filed: Sep. 8, 1986

[51] Int. Cl.[4] ..... F23D 14/00; F23G 5/00; F23G 5/12

[52] U.S. Cl. ..... 110/236; 110/241; 110/246; 110/346; 134/2

[58] Field of Search ..... 110/236, 237, 246, 346, 110/241; 241/DIG. 10; 134/2

[56] References Cited

U.S. PATENT DOCUMENTS 4,487,372 12/1984 Deve ..... 110/236

4,573,417 3/1986 Deve ..... 110/236 X

*Primary Examiner*—Edward G. Favors

*Attorney, Agent, or Firm*—Gary Appel

[57] ABSTRACT

A sealed, negative pressurized, high temperature furnace, through which hydrocarbon contaminated soil is conveyed, is operated in the near-infrared heating region at radiation wavelengths between about 0.75 and about 3.0 um. The furnace, rotary sealed at the input and exit ports and maintained at a negative pressure, is in the form of an elongated cylinder, divided into four series-arranged heating zones, each of which is separately fed by a preferably stoichiometric mixture of a combustible gas, preferably propane and air. The flow of the gas/air mixture into each of the heating zones is regulated so that the first zone is maintained at about 2900° F. normally, (3000° F. maximum), the second zone is maintained at about 2900° F. normally, and the third and fourth heating zones are maintained at about 2900° F. normally.

46 Claims, 8 Drawing Figures

SPECTRAL DISTRIBUTION OF POWER

APPARATUS AND METHOD FOR TREATMENT OF SOIL CONTAMINATED WITH HYDROCARBONS

BACKGROUND OF THE INVENTION

Field of the Invention

The present invention relates generally to the field of apparatus for thermal detoxification of polluted soil and more particularly to mobile apparatus for infrared heating (retorting) of soil contaminated with hydrocarbons.

Discussion of the Prior Art

Contamination of earth (soil) by petroleum and other hydrocarbons is a common occurrence. Such contamination may, as examples, occur as a result of over-filling or damage to above-ground storage vessels, the rusting or corrosion of underground storage tanks, careless oil well drilling practices or oil wellhead blowouts, or damage to transport ships which causes spilled or leaking oil to wash ashore. The resulting contamination of the soil causes many environmental problems. The hydrocarbon materials may, for example, seep or be washed from the soil and enter drinking water supplies and/or the food chain in various ways. Also, the contaminants may be injurious to wildlife. Frequently, old abandoned sites of contamination are forgotten about and housing tracts are later built on the sites. The contaminated soil then creates numerous health problems, including increased rates of cancer, among inhabitants of the homes built in the contaminated sites.

At least in recent years, greater concern has been devoted to the short term and long term health and environmental effects of soil contamination. As a consequence, businesses are typically charged with the responsibility and cost of cleaning up ground areas contaminated due to their activities, whether or not such activities are, in fact, negligent. Also, many attempts are made to environmentally clean up contaminated areas which have long since been abandoned. A well publicized example of such clean up activities is the clean up of the Love Canal area in the United States, a chemically contaminated area which had been later developed into a residential area and which caused serious health problems to the residents.

In some instances, the soil contamination is of such a severe nature that physical removal of the contaminated soil to a remote toxic waste site is necessary. In other situations, on-site decontamination (detoxification) of the soil is possible and, if so, is ordinarily much less costly than trucking the soil to a toxic waste site. In cases in which the soil contamination is essentially non-halogenated hydrocarbons, which is frequently the situation, it is often possible to decontaminate the affected soil by heating (retorting) the soil to a temperature of several hundred degrees °F. in the presence of air to decompose the hydrocarbon contaminants into carbon dioxide and water (steam) and ash.

For purposes of decontaminating soil, special high temperature soil treating apparatus may be provided. However, it is apparent that even relatively small volumetric spills of such hydrocarbon materials as oil may contaminate comparatively large amounts of earth, especially if the spill has had time to seep into the earth. Because, therefore, of the usually large volumes of earth to be treated and the high temperature to which the soil must be subjected in order to completely decompose the hydrocarbon contaminants, efficient operation of the soil decontamination apparatus is very important.

Otherwise, the size of the equipment and the amount of fuel consumed thereby to generate the high temperatures may make contamination clean up so expensive that many spillage accidents will be unreported and/or may ineffectively be covered up with layers of earth to hide the fact that a spillage has occurred. Also, excessively costly decontamination processes may render bankrupt some companies that are responsible for contaminating spills and the costs of decontamination may then fall upon the tax-paying public. In still other cases, high decontamination costs may lead to illegal dumping of contaminated soil, often in otherwise "sanitary" land fills, and may accordingly result in future water supply and public health problems.

There is disclosed in U.S. Pat. No. 3,745,700 to Hahn, a transportable soil drying machine which employs a conventional, aircraft-type jet engine to provide heat to and cause fluidizing of wet soil. The stated purpose of the machine is to dry soil that is otherwise tooo wet for such construction projects as earthen dams, roadways, and airport runways, thereby avoiding costly construction delays caused by wet weather and extending construction projects later into the fall and enabling earlier spring starting. Theoretically, equipment such as is disclosed by Hahn could possibly be used for decontamination of hydrocarbon-contaminated soil; however, the present inventor considers that the use of the jet engines for this purpose would not only be excessively expensive in terms of fuel consumed by the engines, but would also be relatively ineffectual at achieving complete soil decontamination and could cause other problems such as air pollution.

Various types of infrared and/or radiant heating apparatus have been described, for example, in U.S. Pat. No. 2,675,905 to Placek; U.S. Pat. No. 2,895,544 to Parsons;

U.S. Pat. No. 4,295,826 to Vasilantone; and U.S. Pat. No. 3,248,099 to Bratko. The Placek patent discloses an infrared heater for heating metal parts for stress relief after welding, or for heat treating and the like. Parsons and Bratko disclose radiating wall furnaces and Vacilantone discloses an infrared dryer for freshly painted products. While these cited patents generally disclose the use of high temperature heating apparatus, none disclose how the heating process might be applied to the specific problems relating to economical and effective decontamination of large volumes hydrocarbon polluted soil.

It is, therefore, an object of the present invention to provide novel apparatus for the decontamination of hydrocarbon-contaminated earth.

Another object of the present invention is to provide novel apparatus for decontaminating hydrocarbon-contaminated earth in a sealed, negative pressurized furnace, which utilizes heat radiation in the near-infrared region to vaporize and incinerate the hydrocarbon contaminants.

Still another object of the present invention is to provide novel apparatus for decontaminating hydrocarbon-contaminated earth which is truly mobile and which can readily be transported from one contamination site to another.

Other objects, advantages and features of the present invention will become apparent to those skilled in the art from the following detailed description taken in conjunction with the accompanying drawings.

SUMMARY OF THE INVENTION

A sealed, negatively pressurized, high temperature soil decontamination apparatus, according to the present invention, for treating contaminated soil comprises a furnace having an outer wall and a refractory inner wall, means for transporting contaminated soil through the furnace in a substantially continuous manner, and means for supplying a combustible mixture of fuel and air into the furnace. Included are means for controlling the fuel and air mixing ratio and the rate of supplying the fuel-air mixture into the furnace for causing the heat temperatures in at least one zone of the furnace preferably to be about 2900° F. The composition of the furnace refractory wall is such that at about 2900° F. the wavelength of the radiation energy is substantially between about 0.75 and about 3.0 μm and is thereby in the near-infrared region of the radiation spectrum.

In an embodiment of the invention, the means for transporting contaminated soil through the furnace includes means for causing intermixing of the soil during transport so as to enable uniform heating therof in the furnace. Included, therefore, in the soil transporting means is an endless loop belt formed in a large mesh configuration, the soil being transported through the furnace in the large openings of the belt. Means are included for supporting the belt in regions of the furnace in which the belt transports soil. The supporting means comprise a plurality of steel rods upon which the belt rides and a refractory hearth upon which the rods are supported. Also included, is a sand-like material which fills the spaces between the steel rods, the sand material also serving as a closed lower surface for the open-mesh belt and further causes, in response to soil transporting movement of the belt thereover, tumbling movement as the soil transported by the belt is to thereby provide good soil intermixing and total exposure of soil to the heat infrared radiation provided in the furnace.

It is preferred that the refractory inner wall of the furnace be spaced radially inwardly from the furnace outer wall so as to form an annular plenum chamber therebetween. Correspondingly, the means for supplying the fuel/air mixture to the furnace supplies the fuel/air mixture into the annular plenum chamber. The refractory inner wall of the furnace is porous so that the fuel/air mixture supplied to the annular plenum chamber flows (diffuses) inwardly through the refractory inner wall. Means are provided for attaching the refractory inner wall to the furnace outer wall, the attaching means including mounting elements which are heat protected by the refractory inner wall.

According to a preferred embodiment of the invention, the furnace is in the form of a horizontally-oriented, elongated cylinder, means being included for dividing the furnace into a plurality of sequential heating zones. In such case, the means for supplying a fuel/air mixture to the furnace supplies the fuel/air mixture separately to each of the heating zones and the controlling means control the flow of the fuel/air mixture to the plurality of heating zones so that the heating zones may, if desired, be maintained at substantially different temperatures. Each of the heating zones radiates thermal energy to the soil being transported therethrough in the near-infrared radiation region. To provide mobility of the furnace, the apparatus includes a towable trailer and means mounting the furnace onto the trailer for enabling the towing of the furnace from one contamination site to another.

It is preferred that the peak radition wavelength in the plurality of heating zones be between about 1.5 and about 3 μm.

It is also preferred that the plurality of heating zones include first, second and third (or more) heating zones for which the respective nominal radiating surface temperatures are about 2900° F. Sealing means seal the furnace to maintain a negatively pressurized combustion atmosphere.

Typically, the contamination of soil being treated comprises hydocarbons and the apparatus includes means for supplying auxiliary (additional) combustion air to the furnace to enable complete combustion of hydrocarbon materials outgassed from the soil by the furnace.

The controlling means preferably also control the flow of the auxiliary combustion air into the furnace to thereby enable the manintaining of the preselected temperatures in the heating zones within desired ranges. Also, in order to further assist in maintaining temperature control in the furnaces, the controlling means are connected for controlling the rates at which soil is transported through the furnace by the transporting means. Moreover, it is preferred that the fuel/air mixture comprises a stoichiometric mixture of air and fuel.

A corresponding method is provided for decontaminating contaminated soil, especially hydrocarbon-contaminated soil. The method comprises the steps of : (1) operating a furnace so that at least one heating zone in the furnace radiates heat energy at a nominal temperature of at least about 2900° F. so as to radiate heat energy at a wavelength in the near-infrared region of the spectrum; and, (2) transporting contaminated soil through the furnace at a rate causing the near-infrared heat in the furnace to decompose the contaminants in the soil. The furnace operating step may include operating the furnace so that a plurality of sequential heating zones are provided, and so that each of the zones radiates heat energy in the near-infrared region.

Preferably, the method also includes providing five heating zones, a first one of the zones being maintained at a normal temperature of about 2900° F., a second one maintained at a normal temperature of 2900° F., and a third one of the zones being maintained at a normal temperature of about 2900° F. Further, the method comprises, according to a preferred embodiment, transporting the contaminated soil through the furnace in a relatively thin layer and in openings in the open-mesh conveyor belt so that there is intermixing and heating exposure of the soil as the soil is transported through the furnace.

According to an embodiment, the soil transporting step includes supporting the belt on steel rods, supporting the steel rods on a refractory hearth and filling the space between the quartz rods with a sandy media. It is preferred that the furnace operating step includes supplying to the furnace a stoichiometric mixture of a combustible gas and air and includes supplying auxiliary air into the furnace to enable complete combustion of combustible gases driven off from the contaminated soil. Also it is preferred that the method includes mounting the furnace on a towable trailer. Moreover, the process may include providing a refractory inner wall of the furnace and includes diffusing said fuel-air mixture through the refractory inner wall of the chamber, the spacing of the inner wall of the furnace inwardly of an outer wall of the furnace providing a plenum chamber between the inner and outer walls into which the fuel-/air mixture is provided.

BRIEF DESCRIPTION OF THE DRAWINGS

The present invention will be more readily understood by a consideration of the accompanying drawings in which.

DESCRIPTION OF THE PREFERRED EMBODIMENT

Figure 1:
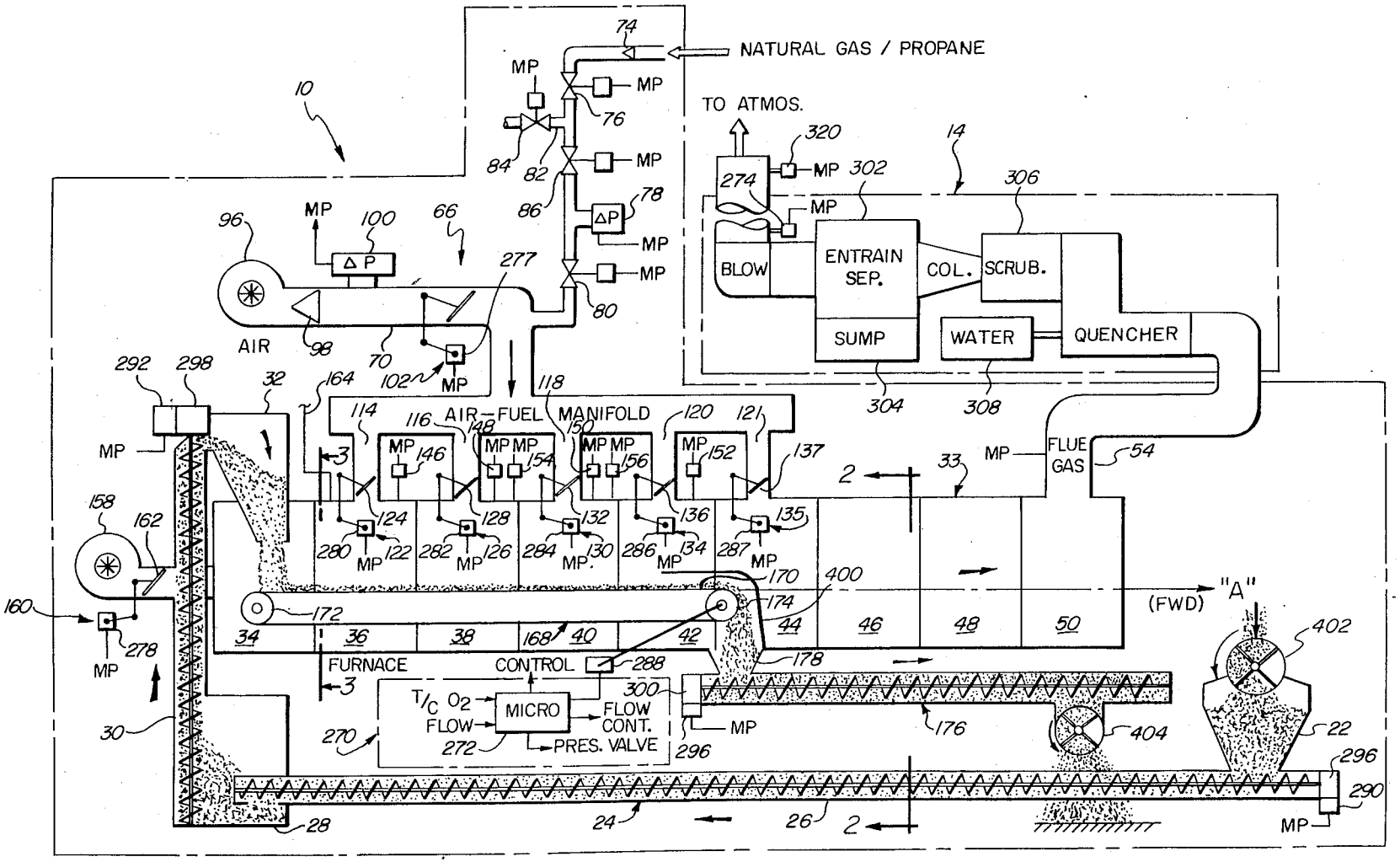
FIG. 1 is a pictorial drawing of a near-infrared, mobile soil decontamination apparatus of the present invention showing major features thereof.

Shown in FIG. 1 is a pictorial diagram of mobile, near-infrared, soil decontamination apparatus 10 according to an embodiment of the present invention. Generally comprising apparatus 10 is an elongate, multi-stage cylindrical furnace means 12 and flue gas treating means 14, both of which may be separately mounted on a pair of generally conventional, flat-bed trailers 16 (FIG. 2) Such trailer 16 is equipped with one or more sets of wheels 18 which enable towing of the soil decontamination furnace and flue gas treating means by a conventional semi-rig (not shown). Alternatively, for some applications, furnace means 12 and flue gas treating means 14 could be mounted on a conventional railroad flat car (not shown) so as to enable apparatus 10 to be transported by rail from one soil decontamination site to another. As still another alternative, furnace means 12 and flue gas treatment means could be permanently maintained at any site requiring on-going soil decontamination.

Associated with decontamination apparatus 10 may be a conventional fuel tank truck (not shown) which enables transporting of fuel, such as propane or LNG used to heat furnace means 12 for soil decontamination, as described below. Included in apparatus 10 may be a diesel, gasoline or other fueled electric generation (also not shown) which enables the apparatus to be self-sufficient with respect to electric power. A front loading machine, such as a Clark "Bob Cat" may be included as part of apparatus 10, for loading contaminated earth into a hopper 22 of earth feeding apparatus 24 which includes an elongate, enclosed screw-type material feeder 26 which transports earth from hopper 22 into feeder 26 which transports earth from hopper 22 into a feed hopper 28 adjacent the inlet end of furnace means 12. From hopper 28, a screw feed 30 feeds soil upwardly into a third hopper 32 which discharges the soil into furnace 12.

As shown in FIG. 1, furnace means 12 is formed of a cylindrical furnace or retort 33 having an inlet stage 34 respective first through fourth heating stages on zones 36, 38, 40 and 42, three flue gas combustion stages 44, 46 and 48 and an outlet stage 50. It is to be appreciated that while four heating stages 36–42 are shown for illustrative purpose, the invention is not so limited. As few as only one or perhaps two heating stages may be provided, or more than four heating stages may be provided, without deviating from the scope of the invention. Four heating stages (stages 36, 38, 40 and 42) have, however, been found to be advantageous and are, therefore, described and shown herein as the preferred embodiment.

Connected to upper regions of input stage 34 is feed hopper 32 (FIG. 1). A flue gas exhaust pipe 54 is connected to upper regions of output stage 50, the exhaust pipe being connected to flue gas treatment means 14 for cleaning of the flue gases, as described below.

Operatively connected to furnace 33 are fuel/air supply and feed means 66 which also form part of furnace means 12. Comprising fuel/air supply means 66 are a fuel conduit means 68 which may be connected to a fuel/air mixing chamber or manifold 72. Included in fuel conduit means 68 are a check valve 74 which prevents any propagation of flame back into the fuel supply, a shut off valve 76, fuel flow measuring means 78,. a pressure control valve 80, and a fuel bleed line 82 having a bleed valve 84. A second shut-off valve 86 is installed in conduit means 68 between flow measuring means 78 and bleed line 82.

Connected to one end of air duct 70 is an air blower 96. A check valve 98, an orifice-type flow measuring means 100 and flow regulation means 102 are installed in air duct 70. Flow regulation means 102 are installed in air duct 70. Flow regulating means 102 include a valve 104 pivotally mounted in duct 70.

Fuel/air mixing manifold 72 is connected to each of first through fifth heating stages 36–44, through respective first through fifth plenum chambers 114, 116, 118, 120 and 121. Included as part of first plenum chamber 114 are first fuel/air flow regulating means 122 which include a damper-type vane 124 mounted across the plenum. Similarly, second fuel/air flow regulating means 126, having a vane 128, are associated with second plenum, 116. Third flow regulating means 130, having a vane 132 are associated with third plenum 118. Fourth flow regulating means 134, having a vane 136, are included in fourth plenum 120.

Fifth flow regulating means 135, having a vane 137, are associated with fifth plenum 121. Furnace stages 5, 6, 7, and 8 zones are effectively at the temperature of stage 5 due to insulation, and although not fired, they are held at temperature due to the hot gases and the thermocouple control being installed in the stack, said thermocouple by feedback to fifth flow regulating means 135 regulates the 5th zone.

Installed in furnace stages 36, 38, 40, and 42 are respective temperature thermocouples 146, 148, 150, and 142. Oxygen sensors 154 and 156 may, as shown, be installed in at least second and third heating stages 38 and 40. A second air blower 158 is shown connected to the end of inlet stage 34 for providing additional (auxilliary) combustion air to furnace 33, as may be needed to burn off flammable gases volatilized from the soil being treated in the furnace. Otherwise, lower than desired heating temperatures in furnace 33 may be caused by the release of gases. Air flow regulating means 160, having a control vane 162, allows make-up air to enter the kiln due to negative pressure −2 inches of water column vacuum.

Fuel/air mixture combusting means 164, which may, for example, comprise an electric spark generator or a piezoelectric igniter, are installed in furance 33 in a location or locations enabling combustion of the fuel-/air mixture. Combusting means 164 may, as shown in FIG. 1, may be installed in first heating stages 36 and are electrically connected to voltage supply means (not shown) in a conventional manner.

Extending generally along a central, horizontal plane and axially along furnace 33, from inlet stage 34 to stage 42 are soil conveying or transport means 168. Generally comprising soil conveying means 168, are more particularly described below, are an endless loop, conveyor or drag belt 170 and first and second sprockets 172 and 174 (FIG. 1) over which the belt is entrained. An electric motor (not shown) is connected for driving second roller 174 to cause movement of conveyor belt 170 through furnace 33. First conveyor roller 172 is rotatably mounted in inlet stage 34 beneath feeding hopper 32 and second roller 174 is rotatably mounted in stage 42. Refractory shield 400, installed in stages 42 and 44, maintain temperature stability in stages 42, 44, 46, 48, and 50.

A funnel-shaped discharge chute 178 is installed in stage 44 beneath second roller 174 in a position to receive retorted and decontaminated soil discharged from conveyor belt 170 as the belt changes direction by 180° by passing around the second roller. Other features of conveyor belt assembly 170 are described below. Chute 178 discharges into screw-type retorted soil transporting means 176 which extends beneath stages 44, 46, 48 and 50 to enable treated soil to be discharged through rotary seal 404 and then onto the ground for pre-spreading as shown in FIG. 2 retorted soil transporting means 176 is disposed in side-by-side, heat transferring relationship with soil feeding means 24 so that soill being fed into furnace 33 is provided an initial preheating.

Figure 3:
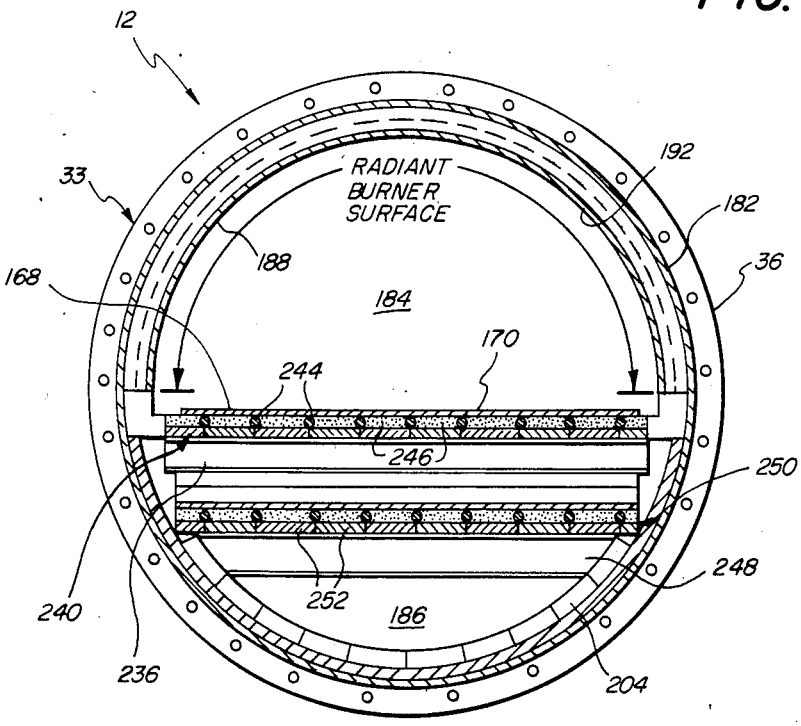
FIG. 3 is a transverse cross sectional drawing taken along line 3—3 of FIG. 1, showing details of the internal construction of a representative one of the several heating stages provided in the furnace.

As shown in FIG. 3, conveyor belt assembly 168 extends laterally across furnace 33. Upper regions of belt 170 are at about mid height of furnace 33 and, with an outer circumferential furnace wall or shell 182, defines an upper, semi-cylindrical heating chamber 184 above the conveyer belt. Return regions of conveyer belt 170 are disposed in a lower, semi-cylindrical region 186 of furnace 33.

Figure 2:
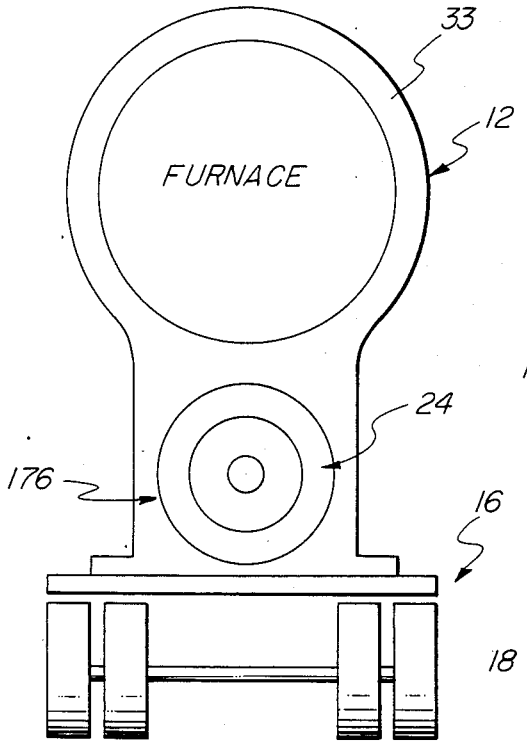
FIG. 2 is a cross sectional drawing taken along line 2—2 of FIG. 1 showing the arrangement of the furnace and soil feeding and discharging means associated therewith.

Heating chamber 184 is more specifically defined in regions above conveyer belt 170 by an elongate, semicircular inner insulating wall 188 (FIGS. 3 and 4) which extends at least the length of stages 34–48, and may extend forwardly into outlet stage 50 and rearwardly into inlet stage 34 (the forward direction being indicated by arrow "A", FIGS. 1 and 2).

Figure 5:
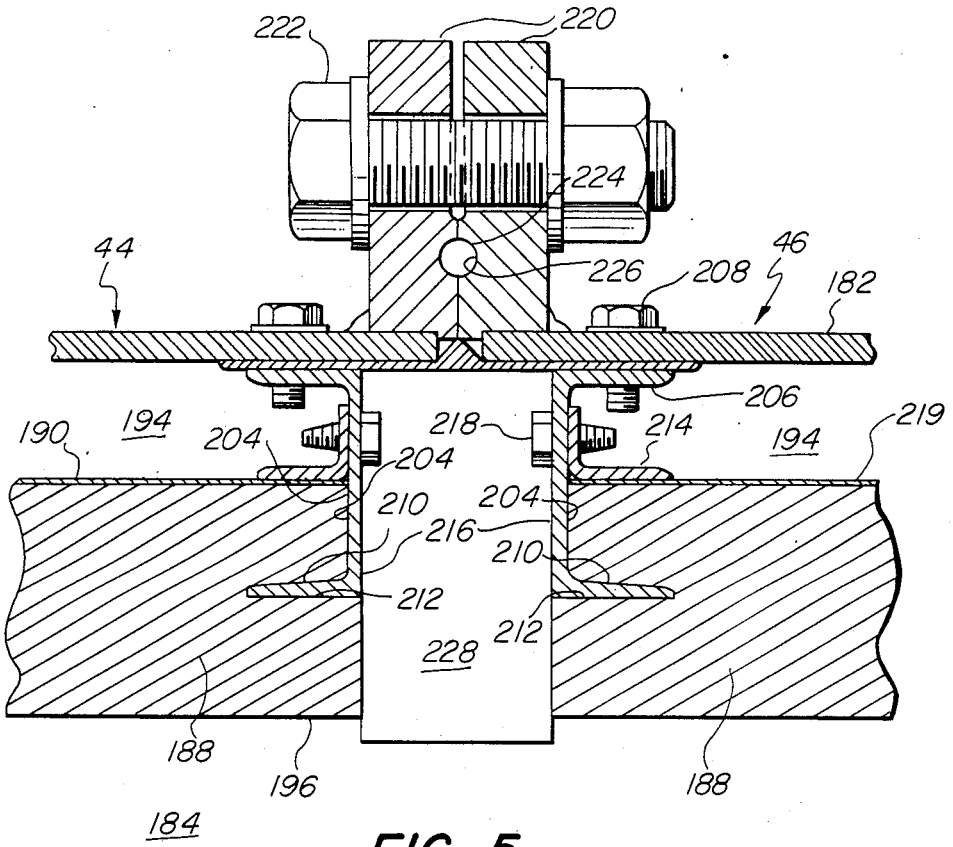
FIG. 5 is a sectional view taken along line 5—5 of FIG. 3 showing the manner in which adjacent stages of the furnace are connected together and showing the manner in which an insulating sleeve is attached adjacent to, but spaced from, an outer wall of the furnace.

Insulated inner wall 188 may, as shown in FIG. 5, be longitudinally segmented at intersections between heating stages 32–50, and is construction of a bonded or scintered matrix of aluminum oxide and silicon dioxide particles having a temperature operating capability of about 3000° F. Inner wall 188 is air and gas permeable and, in fact, constitutes a large surface area, radiant heating heating element which is preferably about two inches thick (in a radial direction).

Figure 4:
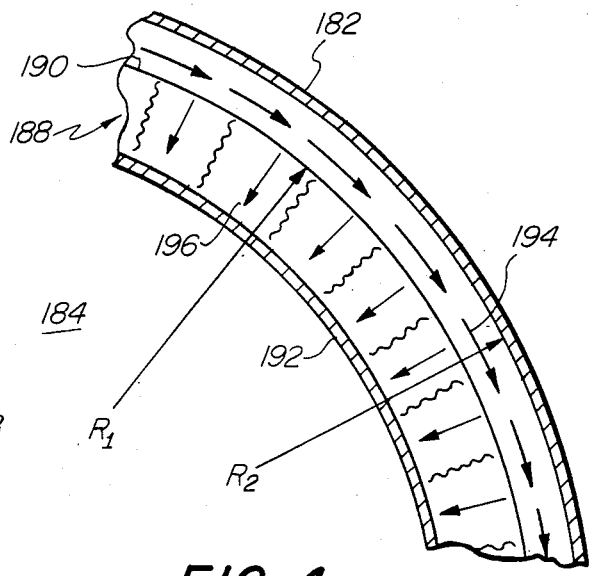
FIG. 4 is an enlarged cross sectional drawing taken generally in the plane of FIG. 3 showing details of furnace construction.

A radius R, to an outer surface 190 of inner wall 188 is about and inch less than a radius $R_2$ to an inner surface 192 of furnace outer wall 182 (FIG. 4). As a consequence, an annular chamber 194 is provided between outer and inner walls 182 and 188 which serve as a fuel-air plenum chamber. Annular chamber 194 is in fuel/air flow communication with heating stage plenums 114, 116, 118 and 120, and receives a stoichiometric fuel/air mixture therefrom. The gaseous fuel/air mixture flows or diffuses, under pressure, from annular chamber 194 radially inwardly through inner wall 188 and is combusted at or slightly below (that is, radially outwardly of), an inner surface 196 of inner wall 188.

An important feature of inner wall 188 is that, as shown in FIG. 5, each longitudinal segment thereof is supported at each end by a semicircular channel 204 having an outer leg 206 fastened by bolts 208 to inner surface 192 of outer wall 182. An inner leg 210 of channel 204 is disposed in a semicircular recess 212 formed in each longitudinal end of inner wall 188. A semicircular angle 214 is fastened to a leg 216 of channel 204 with bolts 218 to hold the segments of inner wall 188 in place. It can be seen that the attaching means, comprising channel 204 and angle 214, are protected by the insulating properties of inner wall 188 from the high heat generated in chamber 184. A metal screen 219 may be attached to inner surface 190 of outer wall 188 to provide additional support thereof.

Also shown in FIG. 5 are means for connecting adjacent stages of furnace 33 together, first and second stages 36 and 38 being shown by way of example. Adjacent annular flanges 220 joined around longitudinal end of segments of outer wall 182 are fastened together by a number of bolts 222. A circular metal ring 224, recessed in grooves 226 formed around flanges 220, provides a flange-to-flange seal between adjacent, bolted-together flanges. A scintered annular washer-shaped ring 228, formed of 3000° F. insulating material, provides a heat seal between adjacent segments of inner wall 188 at the interconnection between each adjacent pair of stages 34–50. Insulating rings 228 also serve to protect channels 204 which support insulating elements 188 from high operating temperatures existing in chamber 184.

Figure 6:
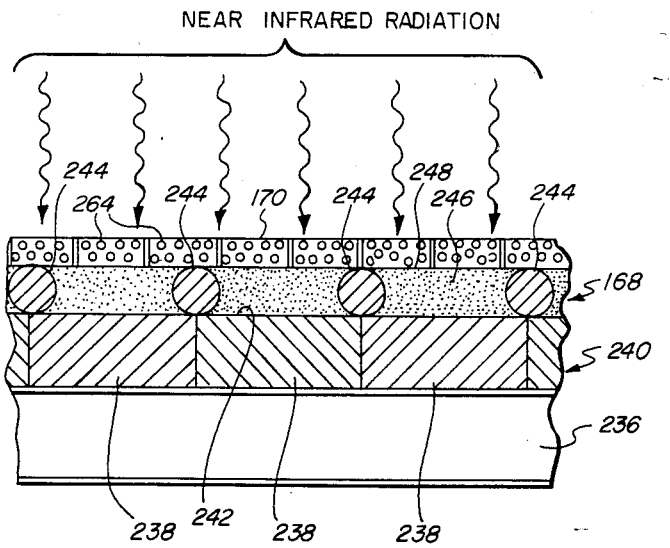
FIG. 6 is an enlarged sectional view taken in the plane of FIG. 3 showing construction of soil conveyor portions of the furnace.
Figure 7:
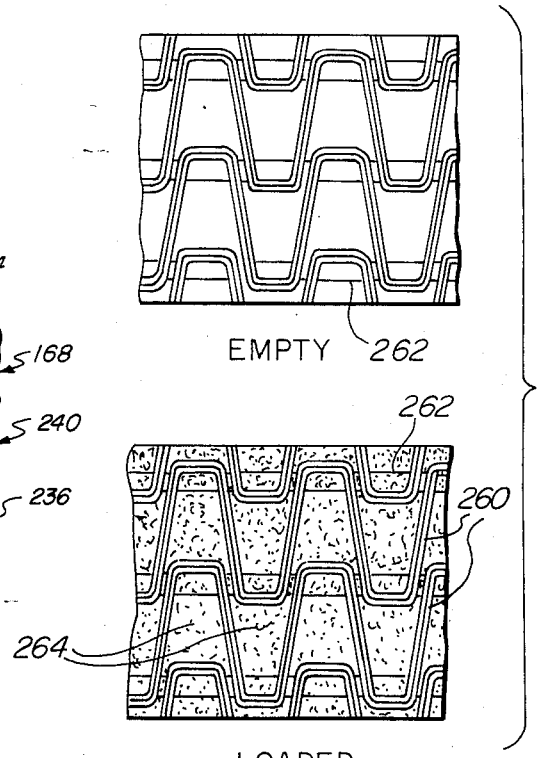
FIG. 7 is a plan view taken along line 7—7 of FIG. 6 showing features of a conveyor belt of the conveyor portion of FIG. 6.

FIGS. 3, 6 and 7 illustrate one manner in which conveyor means 168 may be implemented. Upper, material transporting portions of belt 170 are supported by a hearth support beam 236 (FIGS. 3 and 6) which is mounted across furnace 33 below the transverse central plane thereof. Support beam 236 may comprise a single beam extending about the length of conveyor assembly 168 or may comprise several, or a number of, beam sections.

Supported on beam 236 is a layer of conventional, Kaolin firebricks 28, which may be about 9 by 4 by 1¼ inches in size. Bricks 238 are arranged on support beam 236 in a closely spaced, side-by-side relationship to form a refractory hearth 240 extending across furnace 33 and longitudinally for the length of the support beam, the thickness of hearth 240 being the thickness of bricks 238. Resting upon an upper surface 242 of hearth 240 are a number of longitudinal steel rods 244 which extend the length of the hearth. Rods 244 are laterally spaced apart about the width of firebricks 236 and provide wear strips or guides upon which conveyor belt 170 rides. Regions 246 between adjacent rods 244 are filled (or become filled) with sand or sandy material. Regions 246 are filled with sand to the top of rods 244, an upper surface 248 of the sand serving to close the bottom of belt 170, as described below.

Lower belt return support portions of conveyer assembly 168 are constructed in the same manner as described above for supporting upper portions of conveyor belt 170. Thus, a lower support beam 248 is provided across furnace 33 (FIG. 3) for supporting a hearth 250 of firebricks 252 which, in turn, support a number of longitudinal quartz rods 254 upon lower regions of belt 170 rods. Regions between rods 254 may also be filled with sand.

It should be observed that upper hearth support beam 236 is protected against excessive heating by hearth 240. Similarly, lower hearth support beam 248 is protected against excessive heating by belt 170 by lower hearth 250.

Conveyor belt 170 (FIG. 7) is formed of a large number of generally saw-tooth shaped transverse elements 260 which are pivotally interconnected by transverse pivot pins 262. Such pivot pins 262 function as transverse hinges which enable belt 170 to curve in a small radius around end sprockets 172 and 174 (FIG. 1). Belt 170 is substantially open and may preferably be about 0.8 inches or so in thickness, and about 36 inches wide. Relatively large open regions 264 of belt serve as "pockets" in which the earth to be decontaminated is transported through furnace 33, it being recalled from the above description that the bottom of upper (transporting) regions of belt 170 is effectively closed by upper surface 248 of the sand regions 246 on hearth 240. Electronic control means 270, (FIG. 1) which may, for example, comprise a Westinghouse System, type DCS 1700, controls an on-board Westinghouse microprocessor-based, general purpose control system, type GPC-1550. Included in the on-board control system is a microprocessor 272 which receives electronic inputs from thermocouples 146, 148 150 and 152; from oxygen sensors 154, 155; from gas and air from flow measuring means 78 and 100; and an oxygen sensor 274 in an exhaust stack 276 (FIG. 1) as well as from other system monitoring apparatus (not shown) which may be provided). In response to the electronic system sensor signals receives, microprocessor 272 causes controlling signals to be sent to gas pressure valve 80, to positional drive motors 277 and 278 of respective air flow control means 102 and 160; to positional drive motors 280, 282, 284 and 286, associated, respectively, with fuel/air flow regulating means 122, 124, 126 and 128 of heating stages 36, 38, 40 and 42; to motor control 288, associated with the conveyor drive motor (not shown) and to motor controls 290, 292 and 294 associated with motors 296 and 298 and 300 of soil transport means 24, 30 and 176, respectively. Microprocessor 272 may also be connected to control other functions of apparatus 10, not specifically identified.

Energy costs associated with operation of furnace means 12 can be reduced by taking advantage of the fact that treated (that is decontaminated soil) is discharged from fourth heating stage 42 at a very high temperature. By configuring furnace means 12 (FIG. 2) in that treated soil discharging means 176 is closely adjacent to contaminated soil transporting means 24, heat can be transferred from the treated soil to the untreated soil. As a result, less heat energy is required to elevate the temperature of the contaminated soil to the decontamination temperature. An added advantage of such heat exchanging from treated to untreated soil is that the treated soil is thereby cooled to a lower discharge temperature, making the discharged soil safer to handle and eliminate risks of the discharged soil starting a fire.

The possibility exists that exhaust or flue gases discharged from the last-in-series heating stage 42 may contain driven-off hydrocarbon materials which have not had sufficient time to completely combust. It has, therefore, been found advantageous to provide one or more combustion stages, such as stages 44, 46, 48 and 50 (FIG. 1) downstream of soil treatment stages 36, 38, 40 and 42. Continued combustion by driven-off gases may take place in three downstream stages 44–50 and also the decontamination temperatures of the flue gases are maintained at decontamination levels before dischare through pipe 54. Contaminated soil transporting means 24 advantageously passes concentrically through decontamination soil transporting discharge means 176 to receive pre-treatment heating.

Although the flue gases discharged from the last-in-series stage 50 through pipe 54 are expected to be completely combusted, there may be entrained in the flow of discharged gases such particulate matter as fly ash and dust as fine particulate soil. In general, the discharge into the atmosphere of such flue gases containing ash, dust and particulate matter is undesirable and may, in fact, be in violation of clean air regulations.

Flue gas treating means 14, which may be mounted on car accompanying trailer (not shown) provide for the removing of fly ash, dust, particulate matter, to clean the flue gases discharged through pipe 54. Comprising treatment means 14 are a quencher 310, collision scrubber 306, a water tank 308, an entrainment separator 302 and pump 304, and a blower 300.

Flue gases discharged from furnace 33 through pipe 54 flow, in sequence, through quencher 310, collision scrubber 306, and entrainment separator 302. Collision scrubber 306 and quencher 310, into which water from tank 308 is sprayed by a pump (not shown), are preferably of known conventional design.

Flue gas sampling and analysis means 320 of conventional types are attached to flue gas stack 276, electric signals relating to gas quality are directed to microprocessor 272 of control means 270. Responsive to signals from such flue gas sampling and analysis means, control means 270 can, for example, operate to adjust the fuel-air mixture enterng heating chambers 32, 34, 36 and/or 38 of furnace 13 to provide more complete combustion of driven-off hydrocarbons.

THEORY OF OPERATION

The interior of furnace 33 is configured so that a stoichiometric mixture of air and fuel is perfectly burned just below surface 196 of refractory inner wall 188 (FIGS. 4 and 5). A minimum amount of air is used so that the production of $NO_x$ is minimized in flue gases.

Heat energy, in heating stages 36, 38, 40 and 42 is transferred to the earth (transported by conveyer belt 170) according to the expression:

$$Q=EAG(T_1^4-T_2^4), \quad (1)$$

In equation 1, Q is the energy (in BTU/ft.$^2$/min.) transferred by radiation, and E is the emissivity of the radiating surface (i.e. inner surface 190). A is the area of the radiating surface (i.e. of surface 190), G is the Stephan-Boltzman constant ($2.855\times10^{-11}$ BTU/min ft$^2$ °R$^4$), $T_1$ is the color temperature of the radiating surface (i.e. surface 190) in °R, and $T_2$ is the color temperature of the absorbing surface (i.e. the exposed surface of the earth being transported by conveyor belt 170) in °R.

The relationship between the temperature $T_1$ (in °R) of the radiative surface (i.e. surface 190) and the peak spectral wavelength at which energy is emitted is given by the following expression, commonly known as the Wien Displacement Law:

$$\lambda max = (5216.8/T°R)um \quad (2)$$

The precise radiance value, R, of a near-infrared source (e.g. inner wall 188) is given, for any particular wavelength, by the expression:

$$R = E_\lambda E_\lambda BTU/\text{min ft.}^2 m \quad (3)$$

Wherein $E_\lambda$ is the emissivity of the radiating material, and is a variable inherent with each type of material and is dependent upon temperature, and wherein $E_\lambda$ is given by the following expression known generally as Plank's Spectral Distribution Equation :

$$E_\lambda = \frac{2\pi c^2 h}{\lambda^5}\left[\left(\frac{e^{hc}}{k_\lambda T}\right)^{-1} - 1\right] \text{ in BTU/min ft}^2\text{/m} \quad (4)$$

wherein c is the speed of light ($5.901 \times 10^{10}$ ft/min), h is Plank's constant ($1.047 \times 10^{-38}$ BTU min), is the wavelength (in feet), K is Boltzman's constant (7.23 by $10^{-27}$ BTU/°R) and T is the temperature (°R). Total radiated power is obtained by integrating equation (3) from to as given by.

$$R_{TOT} = \int_{\lambda=0}^{\lambda=\infty} E_\lambda E_\lambda d_\lambda \text{ BTU/min. ft.}^2 \quad (5)$$

for practical purposes, no usable energy is emitted below=0.2 μm in the visible light and ultraviolet light regions, and in regions beyond=20 μm (for infrared region).

Therefore, equation (5) reduces to the expression $$R_{TOT} = \sum_{\lambda=2}^{\lambda=20} R_\lambda \Delta_\lambda \text{ BTU/min ft}^2 \quad (6)$$

Figure 8:
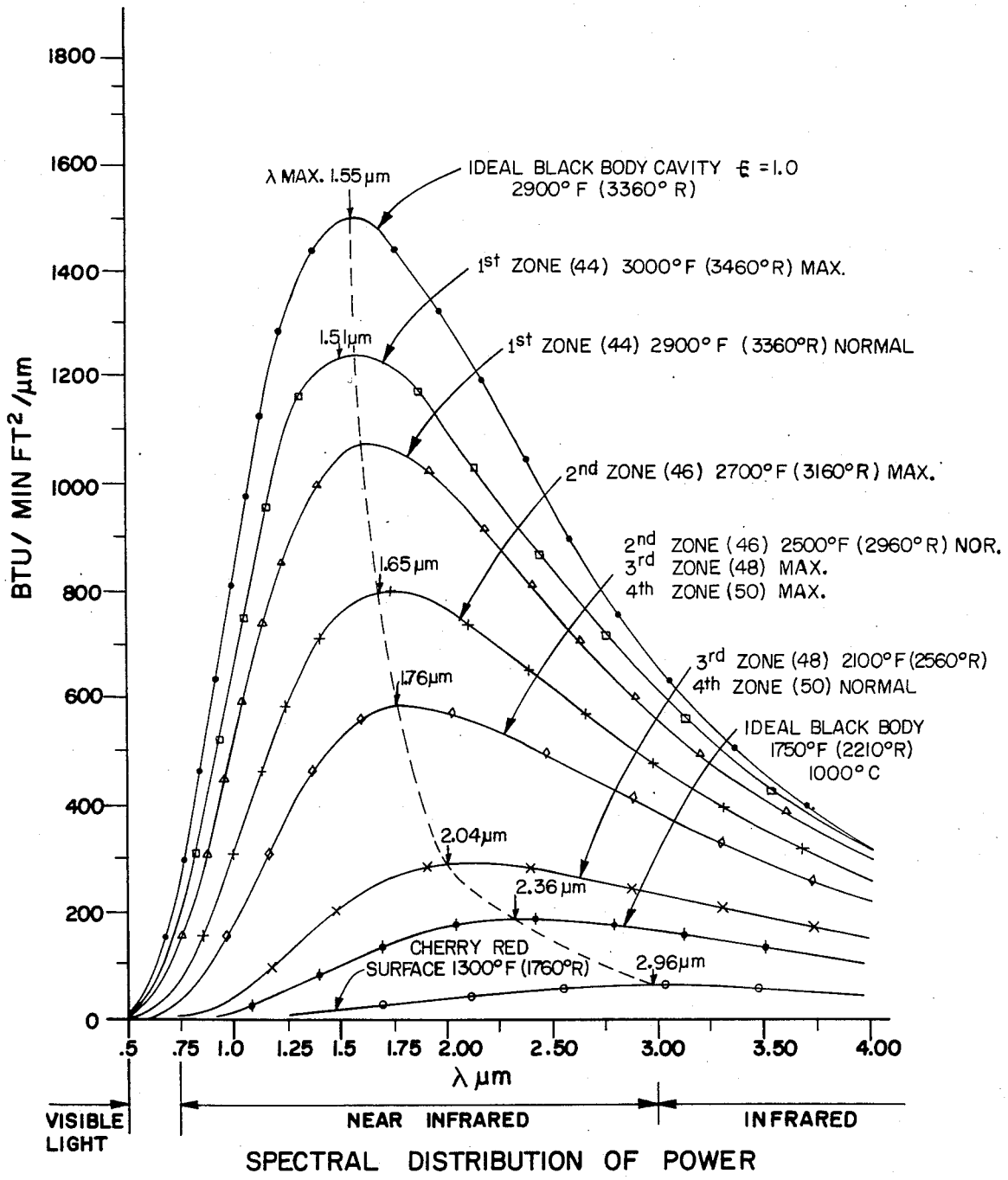
FIG. 8 is a graph on which is plotted Radiance vs. U.S. spectral distribution of power.

Based upon the above-described relationships there is plotted in FIG. 8 $R_{TOT}$ vs wavelength in μm for various emissivities, including those of an ideal black body (E=1.0) at 3360° R and at 2210° R. Also plotted in FIG. 8 are curves representing radiating surface 190 of the present invention for first through fifth heating zones or stages 36, 38, 40, 42, and 44, at respective maximum temperatures of 3460° R, 3160° R, and 2960° R) zones 40 and 42 being assumed to have substantially the same temperatures).

From FIG. 8 it is seen that most of the radiation is in the wavelength range of between about 0.75 μm and about 3 μm (the near-infrared range), with peak radiation being at between about 1.5 μm and about 2 μm.

As can be seen from FIG. 8, it is presently preferred that the fuel/air flow rate into first heating zone 36 is regulated (by means 122, FIG. 1) to maintain the temperatures in such zone at a nominal temperature of about 3360° R (i.e. about 2900° F.), with the maximum temperature in the zone being 3460° R (3000° F.), which is about the maximum temperature permitted by the materials used. At the 3460° R radiating temperature in first zone 36, the fuel energy is transformed most efficiently into near-infrared heat energy which is readily transmitted to earth being treated on conveyor belt 170. At the heat energy levels involved, long chain molecules of hydrocarbon contaminants in the soil being treated are very rapidly disassociated or broken down into simple constituents which are then easily combined (at the elevated temperature in furnace 33) to form carbon dioxide and water vapor, without going through a phase in which the hydrocarbon contaminants are polymerized,as is likely to occur in a slowly heated mass. It is believed that the greater heat enegy associated with the near-infrared radiation creates a high level of photon momentum that is responsible for the rapid, efficient disassociation of the hydrocarbon molecules in the contaminated soil being treated. Soil treatment time for a representative soil treatment rate is about 8.2 cubic yards per hour, the soil being assumed to have a moisture content of about 300 ppm and a $C_xH$ (hydrocarbon) content of about 5300 ppm. Experimental data-derived profile curves show that volatile burn-off occurs in about the first 20 seconds of treatment and that in about 60 seconds all hydrocarbon contaminants have been burned off (i.e. converted to carbon dioxide and steam).

OPERATION

Effective and efficient operation of apparatus 10, and in particular of furnace 33, is dependent upon substantially invariant heat radiation from refractory furnace inner wall 188 and, as well, on substantially constant throughput of contaminated soil by conveyor means 168. If furnace 33 were suddenly to be loaded with a large thermal mass, the temperature in the furnace would rapidly drop due to the great thermal absorption by the mass and, as above mentioned, a variety of contaminants might be emitted into the atmosphere due to the reduced furnace temperature. Outer layers of the soil being treated would become heated while inner, insulated regions would remain less heated. Instead of small amounts of volatiles being instantly oxidized to carbon dioxide and water vapor (steam), the inner regions of the soil, heated in the absence of oxygen, could create large quantities of long chain hydrocarbons.

According to the present embodiment, a stoichiometric mixture of air and fuel are provided in manifold 72, which may include baffles (not shown) to enhance the homogeneous intermixing of the fuel and air. Air may be provided at the rate of about 3.5 tons per hour (7000 pounds per hour) and propane fuel may be provided at the rate of about 450 pounds per hour. A total energy of about $8.9 \times 10^6$ BTU/hour is thereby provided in furnace 33. Preferably furnace 12 may be about 36 feet long, zones 34–50 thereby each being about four feet in axial length. LO The air/fuel mixture in chamber 194 between furnace outer wall 182 and refractory inner wall 188 is caused to be at a pressure slightly greater than atmospheric pressure, for example, at a pressure of about 14.7 psi. Combustion of the air/fuel mixture occurs about 0.15 inches below inner wall radiating surface 190 so that a uniform, flame full near-infrared radiation having a peak wavelength of between about 1.5 and about 2.0 μm is provided. Heating characteristics of the five heating zones 36–42 are summarized below in Table 1.

TABLE 1

| Heating Zone | Max temp. °R | °R | Normal temp. °R | °R | Peak wavelength μm |
|---|---|---|---|---|---|
| 1st (36) | 3460 | 3000 | 3360 | 2900 | 1.5–1.51 |
| 2nd (38) | 3460 | 3000 | 3360 | 2900 | 1.5–1.51 |
| 3rd (40) | 3460 | 3000 | 3360 | 2900 | 1.5–1.51 |
| 4th (42) | 3460 | 3000 | 3360 | 2900 | 1.5–1.51 |
| 5th (44) | 3460 | 3000 | 3360 | 2900 | 1.5–1.51 |

Contaminated earth is preferably transported, by conveyor means 168 through furnace 33 at a rate of between about 10.6 and about 15.9 tons per hour for the above mentioned size of the furnace (i.e. about 3 feet in inner diameter). For a furnace of any particular size, the earth feeding rate depends upon the moisture and hydrocarbon content of the earth being decontaminated. In general, earth having a high moisture content and a low hydrocarbon content will require a slower processing rate than soil having a lower moisture content and a high hydrocarbon rate, the moisture requiring substantial amounts of heat to cause the vaporization thereof, whereas, the hydrocarbons, to some extent, serve as a fuel source. The content of moisture and hydrocarbons in soil to be decontaminated can, of course, be expected to vary extensively and may range from only a few parts per million (ppm) to 10,000 or more ppm. Typically, the temperature of decontaminated soil (i.e. the tailings from furnace 33) are at a discharge temperature between about 842° F. and about 1000° F. Ordinarily, all non-halogenated hydrocarbons will have been volatilized at temperatures above about 842° F.

Typically, a soil analysis is performed in advance of attempting to decontaminate the soil to determine the moisture and hydrocarbon content of the soil and to determine whether any soil contaminants are present which are not "permitted." Such types of contaminants might, for example, include radioactive materials and certain types of pesticides, heavy metals, acids, or bases.

During the transporting of soil through furance 33 by conveyor belt 170, the soil which is held in open spaces 264 of the belt are caused to be tumbled and intermixed by contact of the soil with the below adjacent sand layer between steel rods 244 upon which the belt travels. This type of soil tumbling and intermixing which enables uniform soil heating in the furnace would not, for example, occur if the soil were merely transported on a conventional, closed sheet-type conveyor belt.

Operational control of furnace 33 is provided by electronic control means 270 (FIG. 1) which controls the adjustment of the air/fuel mixture ratio, and the flow rate of the fuel-air mixture into each individual heating stage 36–42 in a manner maintaining the temperatures in each stage within design limits. As an example, temperatures in each heating stage 36–42 and oxygen content in at least second and third stages 38 and 40 and in stack 276, as well as air and fuel flow rates (from respective flow rate) measuring means 100 and 78 are electronically monitored on response to these monitored system parameters, microprocessor 272 controls fuel flow valve 80, air flow regulating means 102 and 160 and fuel/air regulating means 122, 126, 130, 134 and 135 for heating zones 36, 38, 40, 42 and 44 respectively.

If, for example, due to a variation in moisture content of earth being introduced into furnace 33, the temperature in first heating zone 36 decreases, controller 280 of fuel/air mixture flow regulating means 122 into the first heating zone may be controlled by microprocessor 272 to open damper 114 to admit more fuel/air mixture into the first stage. Ordinarily, however, the procedure may be more complicated and microprocessor 172 may also control speed of the conveyor 172 through motor controller 288 and may regulate air and fuel flow into manifold 72 by control of air regulating means 102 and fuel control valve 80. A delicate balancing may thus be performed to maintain proper operating temperatures throughout furnace 33.

As another example, if the soil being decontaminated has a high content of volatile hydrocarbon which serve as a fuel, or rather which add to the fuel consumed in first stage 34, the temperature may fall in the stage due to a richer fuel content. Microprocessor 172 may then cause more air to be introduced, through air flow regulating means 160, into furnace 33 from second air blower 158. At the same time, fuel/air flow regulating means 122 may be controlled to reduce the fuel/air flow into first heating stage 32 from manifold 72. It may, at the same time be necessary to reduce the total flow of fuel and air into manifold 72 (by controlling fuel valve 80) and air flow regulating means 102 while also adjusting the fuel/air flow from the manifold into the five downstream heating stages 36, 38, 40, 42 and 44.

Seal means comprising rotary seals 402 and 404, positioned at the input port and exit port respectively, seal the furnace, maintain the furnace at negative pressure, and prevent leakage of dangerous contamination to the atmosphere.

It will be appreciated that although apparatus 10 has been described by means of which contaminated soil is decontaminated, a corresponding process for soil decontamination is provided.

And, although a particular apparatus and corresponding method for decontaminating contaminated soil have been described above for purposes of illustrating the manner in which the present invention may be used to advantage, it is to be understood that the invention is not limited thereto. Accordingly, any and all variations or modifications which may occur to those skilled in the art are to be considered to be within the scope and spirit of the invention as defined in the appended claims.

What is claimed is:

1. High temperature soil decontamination apparatus for treating contaminated soil, the apparatus comprising:

a. a furnace having an outer wall and a refractory inner wall;

b. means for transporting contaminated soil through the furnace in a substantially continuous manner;

c. means for supplying a combustible mixture of fuel and air into the furnace; and d. means for controlling the fuel and air mixing ratio and the rate of supplying the fuel-air mixture into the furance for causing the heat temperatures in at least one zone of the furnace to be nominally about 2900° F., the composition of the refractory wall being such that at said 2900° F. nominal temperature the wavelength of the radiation energy is substantially between about 0.75 and about 3.0 μm, being thereby in the near-infrared region.

2. The soil decontamination apparatus as claimed in claim 1 wherein the means for transporting contaminated soil through the furnace includes means for causing intermixing of the soil as the soil is transported through the furnace so as to enable uniform heating of the soil in the furnace.

3. The soil decontamination apparatus as claimed in claim 2 wherein the soil transporting means includes an endless loop belt formed in an open mesh configuration, defining openings in the belt, the soil being transported through the furnace in the openings in the belt.

4. The soil decontamination apparatus as claimed in claim 3 incuding means for supporting the belt in regions of the furnace through which the belt transports soil, the supporting means including a plurality of steel rods on which the belt rides and a refractory hearth upon which the rods are supported, and including a sandy material filling spaces between the rods, the sandy material serving as a bottom for the open-mesh belt and causing, in response to soil transporting movement of the belt thereover, tumbling movement of the soil transported by the belt.

5. The soil decontamination apparatus as claimed in claim 1 wherein the refractory inner wall of the furnace is spaced radially inwardly from the furnace outer wall so as to form an annular plenum chamber therebetween.

6. The soil decontamination apparatus as claimed in claim 5 wherein the means for supplying the fuel/air mixture provides the fuel/air mixture into said annular plenum chamber.

7. The soil decontamination apparatus as claimed in claim 6 wherein the refractory inner wall of the furnace is porous so that the fuel/air mixture supplied to the annular plenum chamber flows inwardly through the refractory inner wall into inner regions of the furnace.

8. The soil decontamination apparatus as claimed in claim 1 including means for attaching the refractory inner wall to the furnace outer wall, said attaching means including mounting elements which are heat protected by the refractory inner wall.

9. The soil decontamination apparatus as claimed in claim 1 wherein the furnace is in the form of a horizontally-oriented, elongate cylinder and including means for dividing the furnace into a plurality of separately controllable heating zones.

10. The soil decontamination apparatus as claimed in claim 9 wherein the means for supplying a fuel/air mixture to the furnace supplies the fuel/air mixture separately to each of the heating zones and wherein the controlling means control the flow of the fuel/air mixture to the plurality of heating zones so that at least two of the zones are at substantially different temperatures.

11. The soil decontamination apparatus as claimed in claim 10 wherein each of the heating zones radiate thermal energy in the near-infrared radiating region to the soil being transported therethrough.

12. The soil decontamination apparatus as claimed in claim 1 including a towable trailer and means of mounting the furnace onto the trailer for enabling the towing of the furnace from one contamination site to another.

13. The soil decontamination apparatus as claimed in claim 1 including means for transporting hot contaminated soil from the furnace in a heat-exchanging relationship with contaminated soil being fed into the furnace, preheating of the contaminated soil being thereby provided.

14. The soil decontamination apparatus as claimed in claim 1 including means for cooling flue gases produced as a result of decontaminating the contaminated soil.

15. The soil decontamination apparatus as claimed in claim 1 including at least one additional stage downstream of the heating stages in which continued combustion of the hydrocarbons driven off from the contaminated soil takes place prior to discharge of the flue gases from the furnace.

16. High temperature, soil decontamination apparatus for decontaminated soil, the soil decontamination apparatus comprising:

a furnace having an outer wall and a porous, refractory inner wall spaced inwardly therefrom, an annular plenum chamber being formed between the furnace outer and inner walls;

b. means for dividing the furnace into a plurality of separately controllable axial heating zones, said dividing means also dividing said annular plenum chamber into a corresponding plurality of separate plenum chambers;

c. means for transporting contaminated soil in a substantially continuous manner through the plurality of furnace heating zones;

d. means for supplying a fuel/air mixture to said individual plenum chambers and for causing the fuel/air mixture to diffuse inwardly through the refractory inner wall;

e. control means for controlling the ratio of fuel-to-air in said fuel/air mixture and the flow of the fuel/air mixture into the individual annular plenum chambers so as to cause a plurality of different temperatures in the furnace, the refractory inner wall, the fuel/air mixture and the flow of the fuel/air mixture into the individual plenum chambers causing each of the plurality of heating zones to radiate heat energy in the near-infrared region and thereby having a wavelength substantially between about 0.75 and about 3.0 $\mu$m; and f. seal means for sealing the furnace to maintain a negative pressurized, combustion environment.

17. The soil decontamination apparatus as claimed in claim 16 wherein the peak radiation wavelength in the plurality of heating zones is between about 1.5 and 2 $\mu$m.

18. The soil decontamination apparatus as claimed in claim 16 wherein the plurality of heating zones including first, second, third, fourth and fifth heating zones the respective nominal temperatures of which are at about 2900° F.

19. The soil decontamination apparatus as claimed in claim 16 wherein the soil contamination comprises hydrocarbons and including means for supplying auxiliary combustion air to the furnace to enable combustion of the hydrocarbon material outgassed from the soil by the furnace.

20. The soil decontamination apparatus as claimed in claim 19 wherein the controlling means also control the flow of said auxiliary combustion air into the furnace so as to enable the maintaining of preselected temperatures in said heating zones.

21. The soil decontamination means as claimed in claim 20 wherein the controlling means are also connected for controlling the rate at which soil is transported through the furnace by the transporting means.

22. The soil decontamination means as claimed in claim 16 wherein the fuel/air mixture comprises a stoichiometric mixture of air and fuel.

23. The soil decontamination apparatus as claimed in claim 16 wherein the soil transporting means includes a thick, open mesh conveyor belt configured for transporting the soil through the furnace is open regions of the belt.

24. The soil decontamination apparatus as claimed in claim 23 wherein the conveyor belt rests upon a plurality of steep support rods which are embedded in a layer of sandy media, the sandy media serving as a bottom to the open mesh conveyor belt.

25. A method for decontaminating contaminated soil which comprises the steps of:

a. operating furnace so that at least one heating zone in the furnace radiates heat energy at a uniform, nominal temperature of at least about 2900° F. and radiates heat energy at a wavelength in the near-infrared region of the spectrum, and b. transporting contaminated soil through the furnace at a rate causing the near-infrared heat in the furnace to decompose the contaminants in the soil.

26. The method as claimed in claim 25 including operating the furnace so that a plurality of heating zones are provided, and so that each of the zones radiates uniform heat energy in the near-infrared region.

27. The method as claimed in claim 26 wherein there are five heating zones, a first one of the zones being maintained at a nominal temperature of about 2900° F., a second one of the zones being maintained at a nominal temperature of about 2900° F. and a third one of the zones being maintained at a nominal temperature of about 2900° F.

28. The method as claimed in claim 25 wherein the soil transporting step includes transporting the contaminated soil through the furnace in a relatively thin layer.

29. The method as claimed in claim 28 wherein the soil transporting step includes transporting the soil in openings in the open mesh convey or belt.

30. The method as claimed in claim 25 wherein the soil transporting step includes intermixing the soil as the soil is transported through the furnace.

31. The method as claimed in claim 25 wherein a conveyor belt is used to transport soil through the furnace, the soil transporting step incuding the step of supporting the belt on steel rods.

32. The method as claimed in claim 31, including the step of supporting the steel rods on a refractory hearth.

33. The method as claimed in claim 32 including the step of filling the space between the steel rods with a sandy media.

34. The method as claimed in claim 25 wherein the furnace operating step includes supplying to the furnace a stoichiometric mixture of a combustible gas and air.

35. The method as claimed in claim 34 wherein the furnace operating step includes supplying auxiliary air into the furnace to enable substantially complete combustion of combustible gases driven off from the contaminated soil.

36. The method as claimed in claim 34 including the step of preheating contaminated soil being fed into the furnace.

37. The method as claimed in claim 35 wherein the preheating step includes flowing the contaminated soil in close proximity to a flow of decontaminated soil being discharged from the furnace.

38. A method for decontaminating soil that is contaminated with hydrocarbons, the method comprising the steps of:

a. providing in an elongate furnace a plurality of separate heating zones;

b. providing a refractory inner wall for the furnace;

c. providing a mixture of a combustible gas and air to each of said heating zones and burning the gas/air mixture;

d. transporting hydrocarbon contaminated soil through the furnace in a substantially continuous manner;

e. controlling the mixture of gas and air, the flow rate of the gas/air mixture to the furnace heating zones and the soil transporting rate through the furnace so as to cause the heating zones to radiate heat energy in the near-infrared spectrum, the wavelength of the radiation being substantially between about 0.75 and about 3.0 $\mu$m.

39. The method as claimed in claim 38 wherein first, second, third, fourth and fifth heating zones are provided in the furnace.

40. The method as claimed in claim 38 wherein the controlling step maintains the first heating zone at a nominal temperature of about 2900° F., the second zone at a temperature of about 2900° F. and the third zone at a temperature of about 2900° F.

41. The method as claimed in claim 38 including maintaining the furnace on a favorable trailer.

42. The method as claimed in claim 38 including the step of providing auxiliary air into the furnace at a rate enabling the substantially complete combustion of combustible gases obtained by heating the contaminated soil.

43. The method as claimed in claim 38 wherein the step of providing the fuel/air mixture includes diffusing said mixture through the refractory inner wall of the chamber.

44. The method as claimed in claim 42 including spacing the inner wall of the furnace inwardly of an outer wall of the furnace so as to provide a plenum chamber between the inner and outer walls.

45. The method in claim 44 wherein seal means, placed in the furnace inlet and exit ports, seal the furnace.

46. The method in claim 45 which includes the step of maintaining the furnace at a negative pressure.

* * * * *